United States Patent [19]

McGee

[11] 4,090,565

[45] May 23, 1978

[54] CONTROL LINE TUBING HANGER

[75] Inventor: John K. McGee, Houston, Tex.

[73] Assignee: Gray Tool Company, Houston, Tex.

[21] Appl. No.: 722,753

[22] Filed: Sep. 13, 1976

[51] Int. Cl.[2] ..... E21B 23/00

[52] U.S. Cl. ..... 166/315; 166/85; 285/137 A

[58] Field of Search ..... 166/72, 85, 88, 89, 166/315; 285/18, 24, 27, 137 A, 142, 143, 145

[56] References Cited

U.S. PATENT DOCUMENTS

| | | | |
|---|---|---|---|
| 2,153,852 | 4/1939 | Tschappat | 166/88 X |
| 2,485,497 | 10/1949 | Lemley et al. | 166/88 X |
| 3,134,614 | 5/1964 | Brooks | 285/137 A |
| 3,437,149 | 4/1969 | Cugini et al. | 166/315 |
| 3,806,168 | 4/1974 | McGee et al. | 285/137 A |
| 3,814,179 | 6/1974 | Hull, Jr. | 166/89 |
| 3,830,306 | 8/1974 | Brown | 166/315 |

*Primary Examiner*—Ernest R. Purser
*Assistant Examiner*—Richard E. Favreau
*Attorney, Agent, or Firm*—Cushman, Darby & Cushman

[57] ABSTRACT

A wellhead assembly is provided comprising an upper wellhead assembly, a lower wellhead assembly, a sleeve, and a seal between the sleeve and the lower wellhead assembly. The upper wellhead assembly includes a tubing string section, and a control line, and the control line mounted exterior of the tubing string section. The lower wellhead assembly includes a bore therethrough, through which the tubing string section and the control line pass into the well. The sleeve is operatively connected to the upper wellhead assembly and extends into the bore, surrounding the control line and the tubing string section, the seal being formed between the exterior of the sleeve and the lower wellhead assembly bore. A prefabricated article of manufacture is utilized in the wellhead assembly for facilitating the ease of assembly, the prefabricated article of manufacture including a tubing hanger mandrel, a tubing hanger body operatively connected to the tubing hanger mandrel, a control line receiving port in the tubing hanger body, the tubing string section, and the sleeve. During assembly of the wellhead assembly, a split coupling support assembly is utilized to space the tubing hanger body from the lower wellhead assembly until the entire upper wellhead assembly is connected together (including a tubing bonnet 10) at which time, the split coupling support assembly is removed and the upper wellhead assembly lowered into operative association with the lower wellhead assembly.

18 Claims, 5 Drawing Figures

10

44
23
36'
34'
34'
48
24
16
36
25
22
26
20
19
46
32
40
30
34
34
42
18
35
35
A
39
38
12
14
15'
28
15

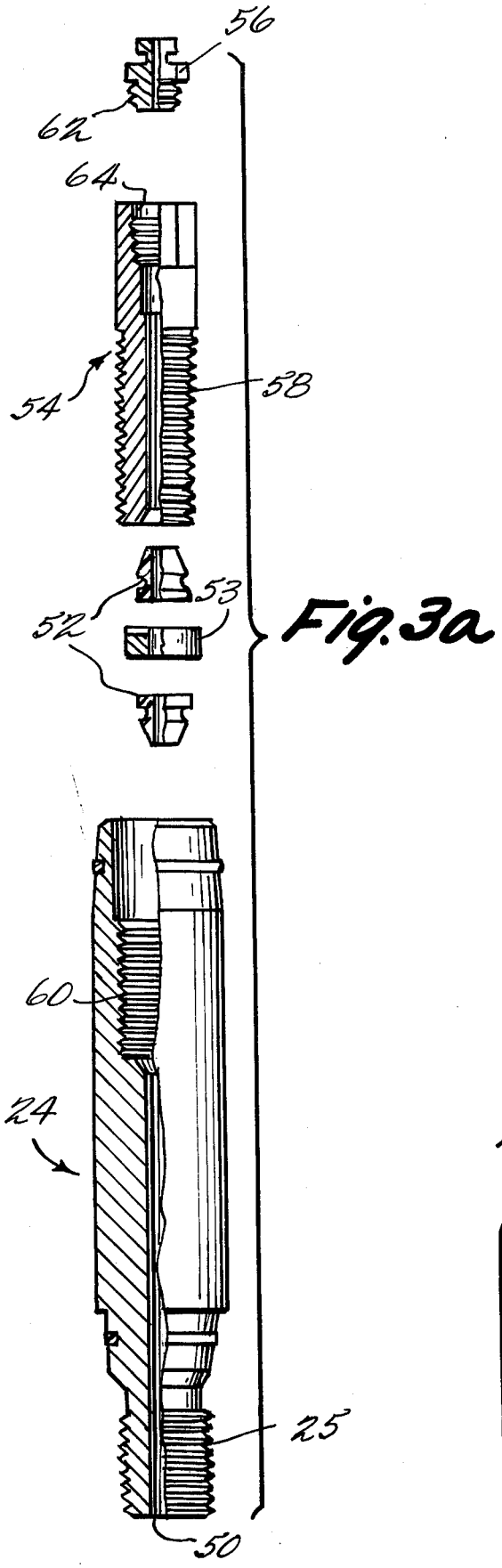
Fig. 3a
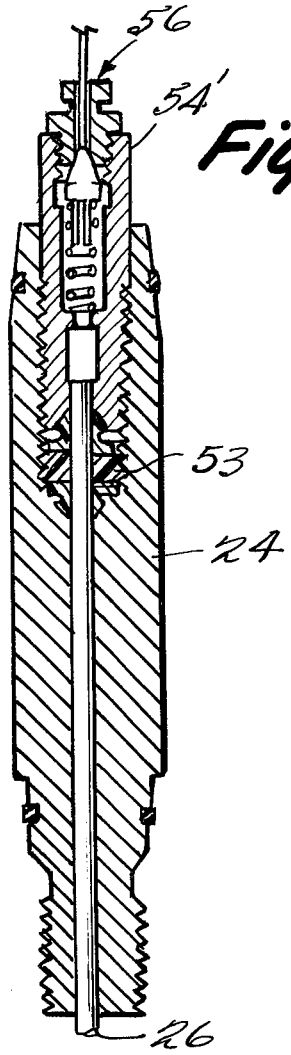
Fig. 3b
Fig. 4
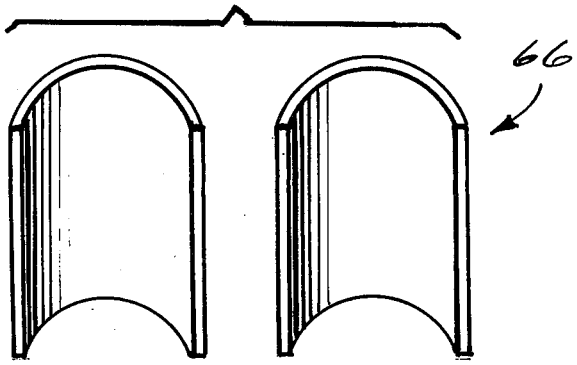

CONTROL LINE TUBING HANGER

BACKGROUND AND SUMMARY OF THE INVENTION

The invention generally relates to a wellhead assembly, and a prefabricated article of manufacture for use therewith, as well as a method for installing the prefabricated article of manufacture in the wellhead assembly. More particularly, the invention relates to a wellhead assembly having a control line associated therewith, the control line running to a structure within the well for effecting hydraulic, pneumatic, or electrical actuation thereof. The control line is not concentric with the tubing string, and is disposed exteriorly thereof, so that the control line may be removed without disturbing the well string. A sleeve is provided surrounding the control line and a section of the upper well string, concentric with the well string but axially spaced therefrom a sufficient distance to allow passage of the control line therebetween. A seal is provided between the lower wellhead assembly and the sleeve, whereby the well is kept under control at all times, eliminating an open hole condition, yet the well string is reciprocal with respect to the wellhead assembly and the sleeve. The sleeve also provides protection for the control line, and provides for positive passage and guidance of the control line down the well into its proper position.

According to the present invention, a tubing hanger mandrel, tubing hanger body having a control line port therein, an upper tubing string section, and the sleeve may be prefabricated as a single article of manufacture (even though the component pieces thereof may be releasably connected), and installed as a single unit in the field. This eliminates the otherwise costly and tedious field assembly that would be necessary, and greatly simplifies the installation procedure. A split coupling support assembly may be provided associated with the prefabricated article of manufacture to facilitate the installation thereof in the wellhead assembly, the coupling support only being utilized in the installation procedure, and being removed before actual connection is made between the lower wellhead assembly and the tubing bonnet.

According to one aspect of the present invention, a wellhead assembly is provided comprising an upper wellhead assembly including a tubing string section, a control line, and means for mounting said tubing string section and for mounting said control line exterior of said tubing string section, a lower wellhead assembly including means defining a bore therethrough through which said tubing string section and said control line pass, a sleeve operatively connected to said upper wellhead assembly and extending into said bore and surrounding said control line and said tubing string section, and means for forming a seal between said lower wellhead assembly and said sleeve.

According to another aspect of the present invention, an article of manufacture for use in the wellhead assembly is provided, said article comprising a tubing hanger mandrel, a tubing hanger body operatively connected to said tubing hanger mandrel and adapted to be connected to a tubing bonnet of a wellhead assembly, means defining a control line receiving port and said tubing hanger body, said port adapted to receive a control line therein to pass through a lower wellhead assembly, a tubing string section operatively connected to said tubing hanger mandrel and adapted to extend past the tubing hanger body into and through a lower wellhead assembly, and a sleeve operatively connected to said tubing hanger body and concentric with, but axially spaced from, said tubing string section, said sleeve adapted to extend into a lower wellhead assembly and form a seal therewith. A method of assembling a wellhead assembly is also provided, utilizing the article of manufacture according to the present invention, the method comprising the steps of running a control line through the control line receiving port of the tubing hanger in supporting the control line in the port, inserting the tubing well string section and sleeve of the article of manufacture partially into the lower wellhead assembly while supporting the tubing hanger body spaced from the lower wellhead assembly by disposing a coupling support assembly between the lower wellhead assembly and the tubing hanger body surrounding the sleeve, operatively connecting the tubing hanger body to the tubing bonnet, while the tubing hanger body is supported spaced from the lower wellhead assembly, removing the coupling support assembly from between the lower wellhead assembly and the tubing hanger body, and lowering the tubing bonnet into sealing engagement with the lower wellhead assembly.

It is the primary object of the present invention to provide a wellhead assembly, wherein the tubing string is reciprocal with respect to the assembly, while a seal is still maintained to keep the well under control and eliminate an open-hole condition, to protect a control line operatively associated with the wellhead assembly, while providing positive passage and guidance therefor, and allowing removal of the control line without consequent removal of the tubing string; to provide an article of manufacture utilizable in the wellhead assembly that eliminates expensive and time-consuming field installation and simplifies field installation procedures; and to provide a simplified method of field installation of a wellhead assembly having a control line associated therewith. This and other objects of the invention will become clear from an inspection of the detailed description of the invention and from the appended claims.

BRIEF DESCRIPTION OF THE DRAWINGS

FIG. 3*a* is a exploded view of an exemplary control line hanger body according to the present invention, such as shown in FIG. 2;

FIG. 3*b* is a modified form of a control line hanger body shown in assembled relationship; and FIG. 4 is a perspective view of a split coupling support assembly utilizable in practicing the method of wellhead assembly according to the present invention.

DETAILED DESCRIPTION OF THE INVENTION

Figure 1:
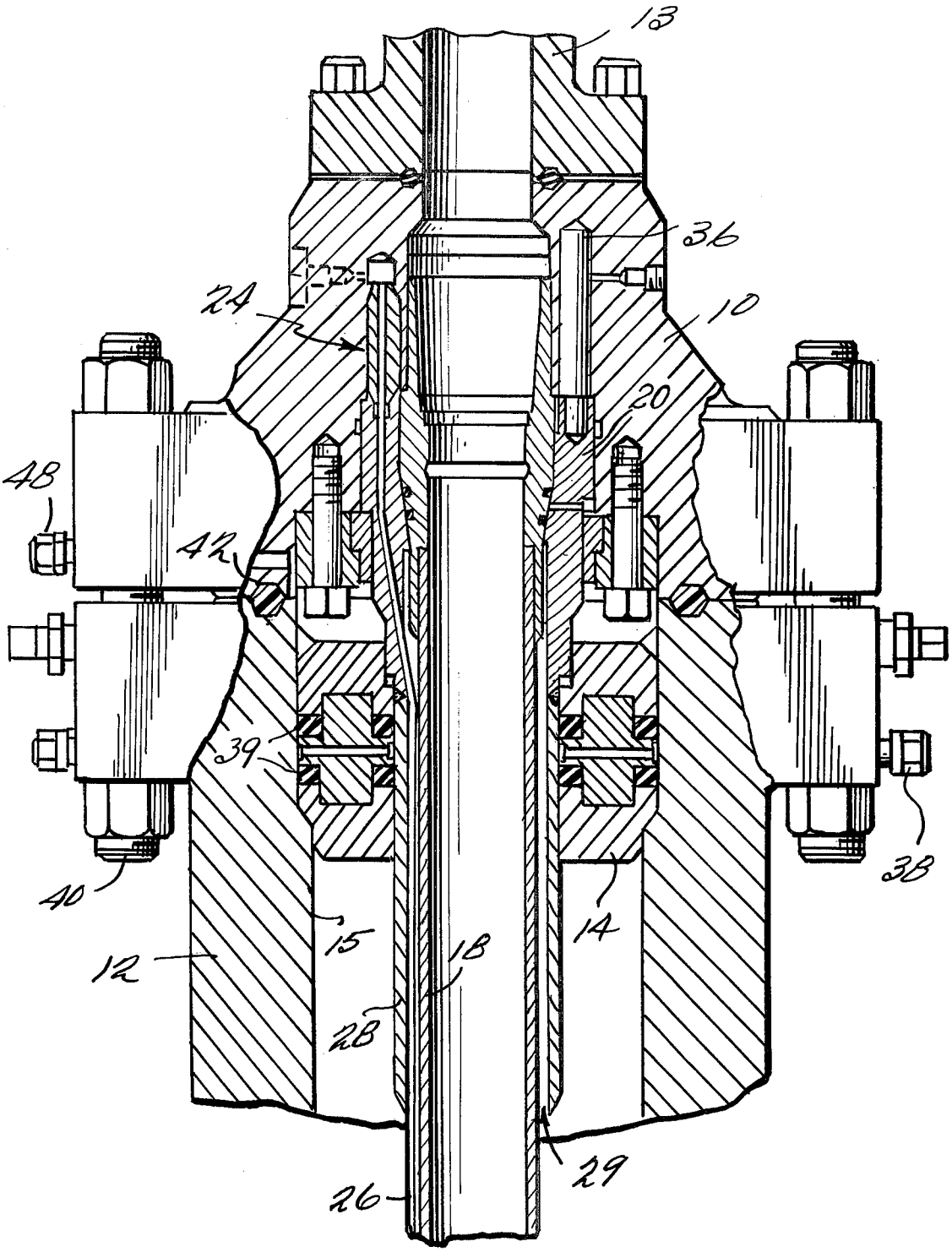
FIG. 1 is a view of an assembled wellhead assembly according to the present invention shown partly in cross-section and partly in elevation.

The drawings illustrate an exemplary wellhead assembly, and article of manufacture according to the present invention, the reference numerals in the drawings referring to the following structures:

10 - tubing bonnet
12 - lower wellhead assembly
13 - Christmas tree

14 - split section pack off assembly
15 - bore
15' - bore
36' - alignment pin receiving cavity
34' - retainer screw receiving cavity
16 - tubing hanger mandrel
18 - tubing string section
19 - seal between mandrel and body
20 - tubing hanger body
22 - control line hanger port
23 - control line hanger body receiving cavity
24 - control line hanger body
25 - control line hanger body threads
26 - control line
28 - outer sleeve
29 - space between outer sleeve and tubing
30 - tubing hanger suspension ring
32 - split sleeve
34 - retainer screws
35 - pack-off assembly mounting set screws
36 - alignment pin
38 - plastic injection port
39 - sealing material receiving ports
40 - studs
42 - ring gasket
44 - control line supply port
46 - first test port
48 - second test port
50 - control line hanger body passageway
52 - control line receiving ferrules
53 - spacer
54 - ferrule gland
54' - modified ferrule gland
56 - bleeder plug
56' - bleeder plug with stinger
58 - ferrule gland threads
60 - control line hanger body interior threads
62 - bleeder plug threads
64 - ferrule gland interior threads
66 - split coupling support assembly With particular reference to FIG. 1, a wellhead assembly, according to the present invention, is illustrated, including an upper wellhead assembly, a lower wellhead assembly, a sleeve and means for forming a seal between the lower wellhead assembly and a sleeve. The upper wellhead assembly includes tubing bonnet 10, a tubing string section 18, a control line 26, and means for mounting the tubing string section 18 and mounting the control line 26 exterior of the tubing string section 18. The means for mounting the tubing string section includes a tubing hanger mandrel 16, a tubing hanger body 20, a seal 19 being provided between the mandrel and the body, a control line hanger port 22 for receipt of the control line 26, and a control line hanger body 24, operatively connected to the control line hanger body by threads 25 and securely supporting an end portion of the control line 26 therein. A conventional Christmas tree 13 is mounted on top of the tubing bonnet 10. The lower wellhead assembly 12 includes means defining a bore 15 therethrough, through which the tubing string section 18 and the control line 26 pass, the control line 26 extending downwardly into the well to a down hole structure which it is operatively connected to for effecting hydraulic, pneumatic, or electrical operation thereof. An outer sleeve 28 is operatively connected to the upper wellhead assembly and extends into the bore 15, surrounding the control line 26 in the tubing string section 18. The outer sleeve 28 is concentric with the tubing string section 18, but radially spaced therefrom a distance sufficient to allow the passage of control line 26 therebetween. Means for forming a seal between the lower wellhead assembly 12 and the sleeve 28 is provided including pack-off assembly 14, and means 39 for receiving plastic sealing material under pressure for providing a seal between the sleeve 28 and the pack-off assembly 14, and between the pack-off assembly 14 and the bore 15. Set screws 35 are provided for mounting the pack-off assembly 14 in place in bore 15. A bore 15' extends through this pack-off assembly 14 for receipt of the sleeve 28. Injection ports 38 cooperate with the plastic sealing material injection ports 39 to supply the sealing material thereto. The wellhead assembly, according to the present invention, allows reciprocation of tubing string 18 with respect to the assembly 12, 10, 14, while a seal (at 39) is still maintained to keep the well under control and eliminate an open-hole condition. Also, the control line 26 is reciprocal with respect to the assembly 10, 12 without movement of the tubing string 18 being necessary, and the control line is protected and positive passage and guidance therefore is provided.

The tubing bonnet 10 is operatively connected to the lower wellhead assembly by studs 40, or the like, the studs 40 providing means for operatively connecting the bonnet and lower wellhead assembly. The control line supply port 44 in the tubing bonnet 10 is in communication with the control line 26 received by the control line hanger body 24. Means are also provided for ensuring proper alignment between the tubing bonnet 10 and the tubing hanger body 20 and for facilitating connection therebetween, such alignment means including the control line hanger body 24, one or more alignment pins 36 provided as dummy control line hanger bodies and symmetrically located about the periphery of tubing hanger body 20, and means 23 for receiving the control line hanger body 24 and alignment pins 36 in the tubing bonnet 10. Any number of control line hanger bodies 24 may be provided in the tubing hanger body 20, it being only necessary to provide a port 22 extending through the body 20 for each control line hanger body 24 to be received. The alignment pins 36 are constructed to be interchangeable with the control line tubing bodies 24, so that when no control line tubing body 24 is to be provided in a port 22 an alignment pin 36 is inserted in its place.

Means are also provided for operatively connecting the tubing bonnet 10 to the tubing hanger body 20, said means including a tubing hanger suspension ring 30, a split sleeve 32, and retainer screws 34. The studs 40 ultimately connect the tubing bonnet 10 to the lower wellhead assembly 12, with ring gasket 42 providing a seal between members 10 and 12.

The control line hanger body 24, as shown in FIG. 3*a*, preferably has a bore 50 extending therethrough for receipt of control line 26, the control line 26 being inserted within the body 24, so that the end portion thereof does not extend past the top portion of the body 24 itself. A pair of ferrules 52, with the spacer 53 therebetween, is received by the body 24, and securely mounts the control line 26 in the hanger body passageway 50 providing a seal thereat. A ferrule gland 54, having portions 58 thereof threaded into cooperating portions 60 in the hanger body 24, engages the top ferrule 52 providing compression of the ferrules 52 and spacer 53, and positive location thereof. A bleeder plug 56 is provided on the top of ferrule gland 54, threaded engagement being provided between the plug 56 and gland 54 by threads 62 and 64. The bleeder plug 56 is installed during running stages to prevent contaminants from entering the control line 26, and is removed before the hanger body 20, with control line hanger 24 attached thereto, is operatively attached to the tubing bonnet 10. An alternative construction that the ferrule gland 54 and bleeder plug 56 can take is shown in FIG. 3*b* at 54′ and 56′, respectively. The ferrule gland 54′ has a spring disposed therein for biasing the stinger valve portion of the plug 56′ into normally closed engagement, the stinger valve automatically being opened when the body 24 is inserted into cavity 23, since a bordering portion of the cavity 23 will engage the portion of the stinger extending above the plug 56′.

Figure 2:
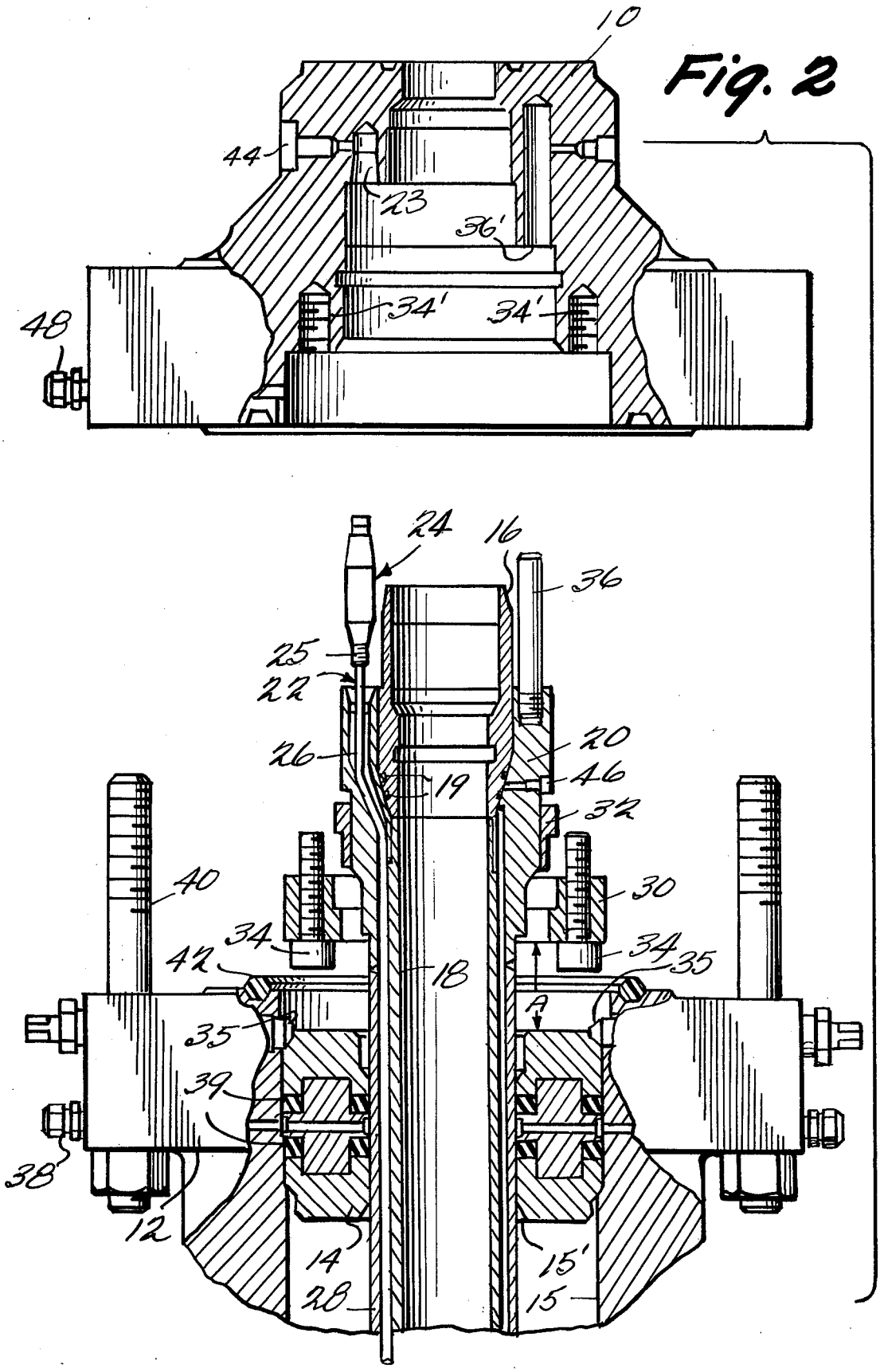
FIG. 2 is an exploded view of the assembly of FIG. 1, again, partly in cross-section and partly in elevation.

An article of manufacture for use in the wellhead assembly according to the present invention eliminates expensive and time-consuming field installations, and simplifies the entire installation procedure. Such an article of manufacture includes the tubing hanger mandrel 16, the tubing hanger body 20 operatively connected to the tubing hanger mandrel 16, means defining a control line receiving port 22 in the tubing hanger body 20, a tubing string section 18 operatively connected to the tubing hanger mandrel 16, and the sleeve 28 operatively connected to the tubing hanger body 20 and concentric with, but axially spaced from (a distance sufficient to allow the passage of control line 26 therebetween) the tubing string section 18. A seal is provided at 19 between the mandrel 16 and body 20, and a test port 46 is provided for introducing fluid into the area adjacent the seal 19 for testing the seal. As previously mentioned, a plurality of bores 22 may be provided, each for receipt of a control line hanger body 24 and control line 26 therein. A force-fit preferably is provided between the mandrel 16 and body 20, although other arrangements for operatively connecting these structures may be provided, such as cooperating threaded portions. Preferably, the upper tubing section 18 is provided with exterior threads for cooperating with interior threads formed on the mandrel 16 for releasably attaching these structures. The outer sleeve 28 may be integral with (as shown in the drawings) or releasably connected to the tubing body 20 (i.e., by threads or the like), however, if a threaded connection is provided, a proper seal must be provided between the members 20, 28. Since the whole assembly 16, 18, 20 and 28 is prefabricated at the factory, and shipped to the well site, expensive and tedious assembly thereof at the well site is avoided and installation procedure is facilitated. A split coupling support assembly 66 (see FIG. 4), which is adapted to be disposed around the sleeve 28 during installation of the tubing hanger body 20 in the wellhead assembly (elements 66 being provided at area A of FIG. 2) may be provided to facilitate the installation procedures.

According to a method of assembling the wellhead assembly according to the present invention, utilizing the prefabricated article of manufacture 16, 18, 20, 28, a control line 26 is run through the control line receiving port 22 of the tubing hanger 20, and the control line 26 is supported in the port 22. The tubing string section 18 and sleeve 28 of the article of manufacture are then partially inserted into the lower wellhead assembly 12, while the tubing hanger body 20 is supported spaced from the lower wellhead assembly 12 by the disposition of coupling support assembly 66 between the lower wellhead assembly 12 and the tubing hanger body 20 surrounding the sleeve 28 (in area A of FIG. 2). The tubing hanger body is then operatively connected to the tubing bonnet 10, while the tubing hanger body 20 is supported spaced from the lower wellhead assembly 12. The coupling support assembly 66 is then removed from between the lower wellhead assembly 12 and the tubing hanger 20, and the tubing bonnet 10 is lowered into sealing engagement with the lower wellhead assembly 12. A seal is effected between the lower wellhead assembly 12 and the sleeve 28 by injecting plastic material under pressure into cavities 39 through injection ports 38, and the adequacy of such a seal is tested through test port 48. Fluid introduced into test port 48 also tests the seal provided by ring gasket 42. In general, according to the present invention, test ports are provided, so that independent sequential testing of all of the sealing elements (19, 42, and 39 in particular) may be effected.

Exemplary structure, according to the present invention having been described, and a general method of assembly according to the present invention having been set forth, a more detailed description of the assembly of the component parts into the completed structure shown in FIG. 1 will now be set forth. The prefabricated article of manufacture 16, 18, 20 and 28 is attached to other sections of tubing string (the tubing string having a valve or like device to be controlled at the bottom or at an intermediate portion thereof), and the tubing is run to the proper depths for the installation of a subsurface B.O.P. or the like. A control line 26 is then run from the B.O.P. valve to the surface, the control line being run between the sleeve 28 and tubing section 18 up through the control line receiving port 22 until it extends exteriorly of the hanger body 20. The control line hanger body 24 is then screwed into place (by threads 25) into port 22, the end of the line 26 being flush with the top of the body 24. Then the ferrules 52 and spacer 53 are inserted into the body 24 to provide a seal for the line 26, and the ferrule gland 54 is screwed down into the body 24. The plug 56 is disposed on top of the ferrule gland 54 until the tubing bonnet 10 is ready to be assembled onto the rest of the structure, at which time the plug 56 is removed. Alignment pins 36 are provided in ports 22 not receiving a body 24, or in corresponding symmetrically spaced openings around the body 20.

Before the bleeder plug is installed on top of the body 24, the control line seals are tested (to 10,000psi) and after satisfactory testing, the pressure is bled off and the bleeder plug 56 is installed, making sure that the bleeder screw is closed. Testing of the seals 19 is also accomplished through test port 46. If a tubing plug is to be used, it should be installed within the mandrel 16 and tubing section 18 at this time.

The pack-off assembly is then disposed around the sleeve 28 by placing the split halves of the pack-off assembly 14 together, and rotating a center ring (not shown) of the pack-off assembly 90° in either direction to lock the halves thereof together. The split halves of the coupling support assembly 66 are then installed between the body 20 and assembly 14 (in area A), and a protective cover (not shown) is placed over the structure 16, 20, etc. with the alignment pins 36 engaging the interior top of the protective cover, and the cover is bolted to the pack-off assembly 14. The entire assembly is then run through the B.O.P. stack, and is landed on the top of the lower wellhead assembly 12. The set screws 35 are then used to set the pack-off assembly 14 in place, and then plastic sealant/lubricant is injected through ports 38 into the receiving openings 39 to activate the seal. The seal may be then tested to the designated pressure.

Th B.O.P. stack is then removed, and the screw of bleeder plug 56 is loosened and the bleeder plug 56 removed (the protective cover having been previously removed). The tubing bonnet 10 is then attached to the body 20, while the split coupling support assembly 66 maintains the body 20 spaced from the assembly 12 (and pack-off assembly 14) by lowering the solid retainer ring 30 over the body 20, inserting the halves of the split sleeve assembly 32 into the solid retainer ring 30, lowering the tubing bonnet 10 with the upper Christmas tree assembly 13 attached thereto down into place over the body 20 (care being taken to insure that the alignment pins 36 and hanger body 24 are received by the openings 23) and lifting the retainer ring 30 with split sleeve 32 together into a cooperating groove formed on the bottom of the tubing bonnet 10. Then the retainer screws 34 are screwed in place and torqued down to specified tightness, whereby the bonnet 10 is operatively connected to the body 20. After successful testing through ports 44, the structure above the coupling support assembly 66 is lifted until it clears the coupling support assembly 66, and then is lowered down into engagement with the lower wellhead assembly 12, the ring gasket 42 providing the seal therebetween. The studs 40 are then used to attach the upper wellhead assembly to the lower wellhead assembly 12, and the connection is tested through ports 48. If a tubing plug has been used, it is then retrieved.

It will thus be seen that according to the present invention, a wellhead assembly, an article of manufacture for use in the wellhead assembly, and a method of assembling a wellhead assembly have been provided that accomplish the objects of the present invention. While the invention has been herein shown and described, in what is presently conceived to be the most practical and preferred embodiment thereof, it will be obvious to those of ordinary skill in the art that many modifications thereof may be made within the scope of the invention, which scope is to be accorded the broadest interpretation of the appended claims, so as to encompass all equivalent structures and methods.

What is claimed is:

1. A wellhead assembly comprising a. an upper wellhead assembly including a tubing string section, a control line of significantly smaller diameter than said tubing string section, and means for mounting said tubing string section and for mounting said control line exterior of said tubing string section, b. a lower wellhead assembly including means defining a bore therethrough, through which said tubing string section and said control line pass, c. a sleeve substantially concentric with said tubing string section and ecentric with said control line operatively connected to said upper wellhead assembly and extending into said bore and surrounding said control line and said tubing string section, and terminating short of said tubing string section in said lower wellhead assembly, and d. means for forming a seal between said lower wellhead assembly and said sleeve.

2. A wellhead assembly as recited in claim 1, further comprising means for providing independent sequential testing of sealing elements of the wellhead assembly, said means including a plurality of test ports.

3. A wellhead assembly as recited in claim 1, wherein said means for mounting said well string section and said control line exterior of said tubing string section comprise a tubing hanger mandrel and a tubing hanger body, said mandrel operatively received by said body releasably connected to said tubing string section, and said body having means defining a control line hanger port therein radially spaced from said tubing hanger mandrel for receipt of a control line hanger body for supporting said control line.

4. A wellhead assembly as recited in claim 3, wherein said upper wellhead assembly further comprises a tubing bonnet receiving said tubing hanger mandrel and tubing hanger body, and means for operatively connecting said tubing bonnet to said lower wellhead assembly.

5. A wellhead assembly as recited in claim 3, wherein said control line hanger body includes a passageway therethrough for receipt of said control line therein, a pair of ferrules spaced by a spacer received by said control line hanger body and securely mounting said control line in said control line hanger body passageway, and a ferrule gland threadly received by said control line hanger body and in operative engagement with one of said ferrules.

6. An article of manufacture for use in a wellhead assembly, said article comprising a. a tubing hanger mandrel, b. a tubing hanger body operatively connected to said tubing hanger mandrel and adapted to be connected to a tubing bonnet of a wellhead assembly, c. means defining a control line receiving port in said tubing hanger body, said port adapted to receive a control line therein to pass through a lower wellhead assembly, d. a tubing string section operatively connected to said tubing hanger mandrel and adapted to extend past the tubing hanger body into and through a lower wellhead assembly, said tubing string section having a diameter significantly larger than the diameter of said port, and e. a sleeve operatively connected to said tubing hanger body and concentric with, and radially spaced from said tubing string section, and ecentric with a control line received by said port, and terminating short of said tubing string section; said sleeve adapted to extend into a lower wellhead assembly and form a seal therewith.

7. An article of manufacture as recited in claim 6, further comprising a control line hanger body disposed in said control line receiving port in said tubing hanger body, and operatively connected to said tubing hanger body.

8. An article of manufacture as recited in claim 7, wherein said control line hanger body includes a passageway therethrough adapted to receive a control line therein, a pair of ferrules spaced by a spacer and disposed in said passageway and adapted to securely mount a control line in said control line hanger body passageway, and a ferrule gland threadly received by said control line hanger body and adapted to be disposed in operative engagement with one of said ferrules.

9. An article of manufacture as recited in claim 8, further comprising a bleeder plug threadly received by said ferrule gland.

10. A method of assembling a wellhead assembly that comprises a tubing bonnet, a lower wellhead assembly, and an article of manufacture, the article comprising a tubing hanger mandrel, a tubing hanger body operatively connected to said tubing hanger mandrel and adapted to be connected to a tubing bonnet of a wellhead assembly, means defining a control line receiving port in said tubing hanger body, said port adapted to receive a control line therein to pass through a lower wellhead assembly, a tubing string section operatively connected to said tubing hanger mandrel and adapted to extend past the tubing hanger body into and through a lower wellhead assembly, and a sleeve operatively connected to said tubing hanger body and concentric with, and radially spaced from, said tubing string section, said sleeve adapted to extend into a lower wellhead assembly and form a seal therewith; said method comprising the steps of a. running a control line through the control line receiving port of the tubing hanger and supporting the control line in the port, b. inserting the tubing string section and sleeve of the article of manufacture partially into the lower wellhead assembly, while supporting the tubing hanger body spaced from the lower wellhead assembly by disposing a coupling support assembly between the lower wellhead assembly and the tubing hanger body surrounding the sleeve, c. operatively connecting the tubing hanger body to the tubing bonnet, while the tubing hanger body is supported spaced from the lower wellhead assembly, d. removing the coupling support assembly from between the lower wellhead assembly and the tubing hanger body, and e. lowering the tubing bonnet into sealing engagement with the lower wellhead assembly.

11. A method as recited in claim 10, comprising the further step of effecting a seal between the lower wellhead assembly and the sleeve.

12. A method as recited in claim 11, comprising the further step of testing the seal between the lower wellhead assembly and the sleeve.

13. A wellhead assembly comprising a. an upper wellhead assembly including a tubing string section, a control line, and means for mounting said tubing string section and for mounting said control line exterior of said tubing string section, said means comprising a tubing hanger mandrel and a tubing hanger body, said mandrel operatively received by said body releasably connected to said tubing string section, and said body having means defining a control line hanger port therein radially spaced from said tubing hanger mandrel for receipt of a control line hanger body for supporting said control line, b. a lower wellhead assembly including means defining a bore therethrough, through which said tubing string section and said control line pass, c. said upper wellhead assembly further comprising a tubing bonnet receiving said tubing hanger mandrel and tubing hanger body, and means for operatively connecting said tubing bonnet to said lower wellhead assembly, d. a sleeve operatively connected to said upper wellhead assembly and extending into said bore and surrounding said control line and said tubing string section, e. means for forming a seal between said lower wellhead assembly and said sleeve, and f. a control line supply port formed in said tubing bonnet and in operative communication with said control line hanger body, and means for providing proper alignment between said tubing bonnet and said tubing hanger body and facilitating connection therebetween, said means including said control line hanger body, an alignment pin provided as a dummy control line hanger body, and means for receiving said control line hanger body and said alignment pin in said tubing bonnet.

14. A wellhead assembly as recited in claim 13, further comprising means for operatively connecting said tubing bonnet to said tubing hanger body, said means including a tubing hanger suspension ring.

15. A wellhead assembly comprising a. an upper wellhead assembly including a tubing string section, a control line, and means for mounting said tubing string section and for mounting said control line exterior of said tubing string section, said means comprising a tubing hanger mandrel and a tubing hanger body, said mandrel operatively received by said body releasably connected to said tubing string section, and said body having means defining a control line hanger port therein radially spaced from said tubing hanger mandrel for receipt of a control line hanger body for supporting said control line, b. a lower wellhead assembly including means defining a bore therethrough, through which said tubing string section and said control line pass, c. a sleeve operatively connected to said upper wellhead assembly and extending into said bore and surrounding said control line and said tubing string section, said sleeve being integral with said tubing hanger body and extending from said body into said lower wellhead assembly bore, and d. means for forming a seal between said lower wellhead assembly and said sleeve.

16. A wellhead assembly comprising a. an upperwellhead assembly including a tubing string section, a control line, and means for mounting said tubing string section and for mounting said control line exterior of said tubing string section, b. a lower wellhead assembly including means defining a bore therethrough, through which said tubing string section and said control line pass, c. a sleeve operatively connected to said upper wellhead assembly and extending into said bore and surrounding said control line and said tubing string section, and d. means for forming a seal between said lower wellhead assembly and said sleeve, said means including a pack-off assembly having a bore therethrough for receiving said sleeve, and means for providing a seal between said pack-off assembly bore and said sleeve, and means for providing a seal between said pack-off assembly and said lower wellhead assembly.

17. A wellhead assembly as recited in claim 16, wherein said means for providing a seal between said pack-off assembly bore and said sleeve includes means for receiving plastic sealing material under pressure.

18. An article of manufacture for use in a wellhead assembly, said article comprising a. a tubing hanger mandrel b. a tubing hanger body operatively connected to said tubing hanger mandrel and adapted to be connected to a tubing bonnet of a wellhead assembly, c. means defining a control line receiving port in said tubing hanger body, said port adapted to receive a control line therein to pass through a lower wellhead assembly, d. a tubing string section operatively connected to said tubing hanger mandrel and adapted to extend past the tubing hanger body into and through a lower wellhead assembly, e. a sleeve operatively connected to said tubing hanger body and concentric with, and radially spaced from, said tubing string section, said sleeve adapted to extend into a lower wellhead assembly and form a seal therewith, and f. a split coupling support assembly adapted to be disposed around said sleeve during installation of said tubing hanger body in a wellhead assembly.

* * * * *